United States Patent [19]

Watabe

[11] Patent Number: 4,830,647

[45] Date of Patent: May 16, 1989

[54] METHOD OF MANUFACTURING GLASS YARNS

[75] Inventor: Kenzo Watabe, Koriyama, Japan

[73] Assignee: Nitto Glass Fiber mfg. Co., Ltd., Fukushima, Japan

[21] Appl. No.: 123,229

[22] Filed: Nov. 20, 1987

[30] Foreign Application Priority Data

Jul. 17, 1987 [JP] Japan ..... 62-178698

[51] Int. Cl.[4] ..... C03B 37/12

[52] U.S. Cl. ..... 65/2; 65/4.3; 65/10.1; 242/18 G; 242/42

[58] Field of Search ..... 65/2, 4.3, 10.1; 242/18 A, 18 G, 42

[56] References Cited

U.S. PATENT DOCUMENTS

| | | | |
|---|---|---|---|
| 3,254,978 | 6/1966 | Hayes | 65/10.1 |
| 3,273,812 | 9/1966 | Lacasse | 242/42 |
| 3,933,456 | 1/1976 | Roberson | 65/10.1 |

*Primary Examiner*—Robert L. Lindsay

*Attorney, Agent, or Firm*—Henry Sternberg; Bert J. Lewen

[57] ABSTRACT

A method of manufacturing glass yarns includes the steps of: forming a large number of glass filaments by drawing molten glass through a large number of orifices formed on the bottom of a bushing; forming a plurality of strands by separately gathering the large number of glass filaments after a sizing agent has been applied thereto with a plurality of gathering rollers aligned in such a manner that they are separated from each other by a predetermined gap; winding the plurality of strands on one winding tube mounted on a collet while traversing the strands by one traverse motion thereby forming one cake; drawing out the ends of the plurality of strands from the outer periphery of the cake and rewinding the cake in the state wherein the strands are separated from each other by a rewinder after the cake has been air dried; and winding each of the strands as a glass yarn on a bobbin while twisting it. In this method, the gap between adjacent gathering rollers, the drawing speed, and the rotational speed and shape of the traverse motion are set such that they ensure that the plurality of strands which are wound on the winding tube so as to form the cake are separated from each other by 2 to 3 mm, and that the average length of the adhered portions of the strands which are formed by being passed through the turns of the traverse motion is between 150 and 350 mm, thereby solving the problems involving the generation of fluffs and breakage of filaments and enabling glass yarns of good quality to be manufactured efficiently.

3 Claims, 2 Drawing Sheets

METHOD OF MANUFACTURING GLASS YARNS

BACKGROUND OF THE INVENTION

1. Field of the Invention

The present invention relates to a method of manufacturing glass yarns, and, more particularly, to a method of manufacturing a plurality of glass yarns at one time from a plurality of strands formed by separately gathering a large number of glass filaments drawn from a multi-hole bushing.

2. Description of the Prior Art

In manufacturing glass fiber, molten glass is drawn at high speed through a large number of orifices formed on the bottom of a bushing so as to form a large number of filaments. After sizing agents are applied to the filaments, they are gathered into a strand by being passed through a gathering roller. The strand is then wound into a cake by a winder while being traversed by a traverse motion. The glass fiber which has been formed into the cake is utilized mainly in the forms of glass roving or chopped strand and glass yarn. To manufacture glass roving, the cake is dried by applying heat for a predetermined period of time. The winding tube is then pulled out from the cake, and the strand is drawn out from inside the cake (this being generally called the internal drawing method). Subsequently, a predetermined number (generally, 10 to 30) of such strands are gathered in parallel so as to form a roving, and the thus-formed roving is wound by a winder. The chopped strand is formed by cutting the roving with a cutter. The thus-formed glass roving or chopped strand is used as a reinforcing material for a fiber glass reinforced plastic or a fiber glass reinforced thermoplastic. In manufacturing a glass yarn, the cake is air dried for a predetermined period of time, and is rewound by drawing out the strand from outside the cake (this being generally called the external drawing method) by means of rewinder. The drawn strand is twisted to form a glass yarn. The thus-formed glass yarn is wound on a bobbin so that it can be used as a material for glass fabric.

The efficiency of producing glass fiber is determined by the weight of glass fiber that can be drawn from a bushing per unit of time (generally this is referred to as one spindle amount), and attempts have therefore been made to increase this one spindle amount by providing a multi-hole bushing. The multi-hole bushing produces a thick strand, and the thick strand raises problems in terms of resin impregnation or surface smoothness when it is used to form a roving which is used as a fiber reinforcing material. These problems, however, can be solved by the division of one strand into several smaller strands and the winding of these smaller strands together on one winding tube. More specifically, in manufacturing a glass roving, a strand is dried in a state wherein it is divided into a plurality of smaller strands, and is drawn out from inside the cake as a bundle of smaller strands to be supplied to a roving winder or cutter, ensuring that solutions can be found to the problems of resin impregnation and surface smoothness of a product which may arise when the roving is used as a material of fiber reinforced plastic or fiber reinforced thermoplastic.

On the other hand, the strand which is used to form a glass yarn is formed by filaments each of which generally has a diameter of 5μ to 10μ. Sizing agents which are mainly composed of a starch type substance are coated on the filaments to gather them into a strand, and the cake formed is air dried. As a result, the resulting strand ehhibits poor integrity when compared with a strand which is used to form a roving, and therefore readily becomes fluffy. Further, since the strand which is used to form a glass yarn must be rewound and drawn out from outside the cake by a rewinder while the cake is being turned around, the strand tends to get even more fluffy, so the conditions of the rewinding process have a great influence on the quality of a product. Applications of glass yarn include fields which demand high quality, such as use as glass cloth for printed circuit boards. Hence it is known to those skilled in the art that methods that can be used to form a glass roving cannot be applied to the manffacture of a glass yarn as they are.

In manufacturing a glass yarn, one way of increasing the spindle amount is to increase the filament drawing speed. However, there is a limit to the extent to which drawing speed can be increased and it is impossible to double it so as to be able to double the production amount owing to the occurrence of filament breakage. The other way consists in the method of forming divided strands with a multi-hole bushing, as in the case of the manufacture of a roving. In this method, divided strands are wound on a plurality of winding tubes aligned in the longitudinal direction of one collet. For example, if a bushing having 600 holes is used, the filaments formed are divided into three blocks to form three strands with each block consisting of 200 filaments, and the three strands are respectively wound on the three winding tubes mounted separately on one collet. This method therefore produces three cakes on three individual winding tubes with each cake formed from one strand.

The above-described known method of manufacturing glass yarns using a multi-hole bushing uses a large number of winding tubes longitudinally aligned, and therefore requires a collet which is as long as one meter or more. In consequence, this method is not safe in high speed operations and involves a troublesome operation of pulling cakes out from the collet. Further, since the relative positional relationship between the collet and the bushing varies greatly at the two ends of the collet, strand quality is adversely affected. As a result, the the number of strands that can be wound in this way is limited to three, and no significant increase in productivity can be expected.

Accordingly, it has been proposed to wind a plurality of strands on one winding tube as one cake, as in the manufacture of a glass roving, to rewind the plurality of strands from the cake, and to twist each of the rewound strands and wind it on a bobbin. However, this propowal has not been put into practical use because of problems involving the generation of fluffs during rewinding and the occurrence of filament breakage, as well as the difficulty of pulling out a strand end which is attributable to the winding of a plurality of strands into one cake.

SUMMARY OF THE INVENTION

An object of this invention is to provide a method of manufacturing glass yarns which is capable of solving the problems of the prior art.

To this end, the present invention provides a method of manufacturing glass yarns which includes the steps of: forming a large number of glass filaments by drawing molten glass through a large number of orifices formed on the bottom of a bushing; forming a plurality of strands by separately gathering the large number of glass filaments, after sizing agents have been applied thereto, with a plurality of gathering rollers aligned in such a manner that they are separated from each other by a predetermined gap; winding the plurality of strands on one winding tube mounted on a collet while traversing the strands by one traverse motion and thereby forming one cake; drawing out the ends of the plurality of strands from the outer periphery of the cake and rewinding the cake in the state wherein the strands are separated from each other by a rewinder after the cake has been air dried; and winding each of the strands as a glass yarn on a bobbin while twisting it, wherein the improvement is characterized in that the gap between adjacent gathering rollers, the drawing speed, the rotational speed of the traverse motion, and the shape thereof are set such that they ensure that the plurality of strands which are wound on the winding tube so as to form the cake are separated from each other by 2 to 3 mm, and that the average length of the adhered portions of the strands which are formed by being passed through the turns of the traverse motion is between 150 and 350 mm.

In this invention, since the plurality of strands are wound on one winding tube, the length of the collet can be made short, solving the problems that might occur due to the use of the known type of long collet. On the other hand, since the present invention involves the formation of one cake from a plurality of strands, problems that might adversely affect the quality of the product may arise in the rewinding process of the present invention. However, these problems can be solved by adjusting the gap between adjacent gathering rollers, the drawing speed, and the rotation speed and shape of the traverse motion so that the gap between the adjacent strands which are wound on the winding tube simultaneously and the average length of the adhered portions of the plurality of strands which are formed by being passed through the turns of the traverse motion are set within predetermined range.

The above and other objects, features and advantages of the present invention will become clear from the following description of the preferred embodiments taken in conjunction with the accompanying drawings.

DESCRIPTION OF THE PREFERRED EMBODIMENTS

Figure 1:
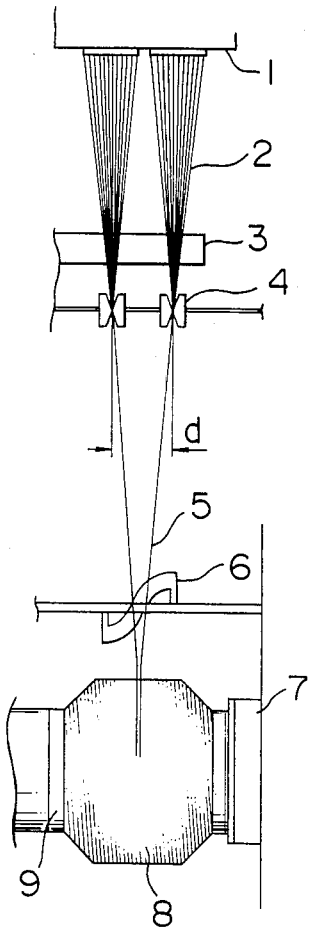
FIG. 1 is a front elevational view of one example of an apparatus used in the glass yarn manufacturing method of this invention to form a cake using a multi-hole bushing.
Figure 2A:
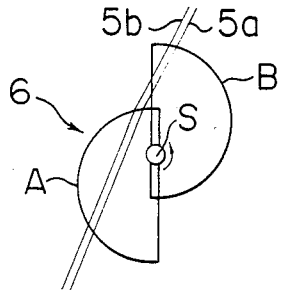
FIGS. 2*a* and 2*b* are side and front elevational views of a traverse motion used in the apparatus of FIG. 1, illustrating the mechanism of the traverse motion.
Figure 2B:
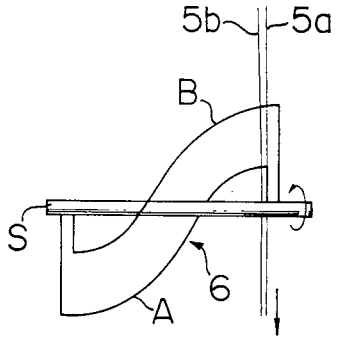
Figure 3:
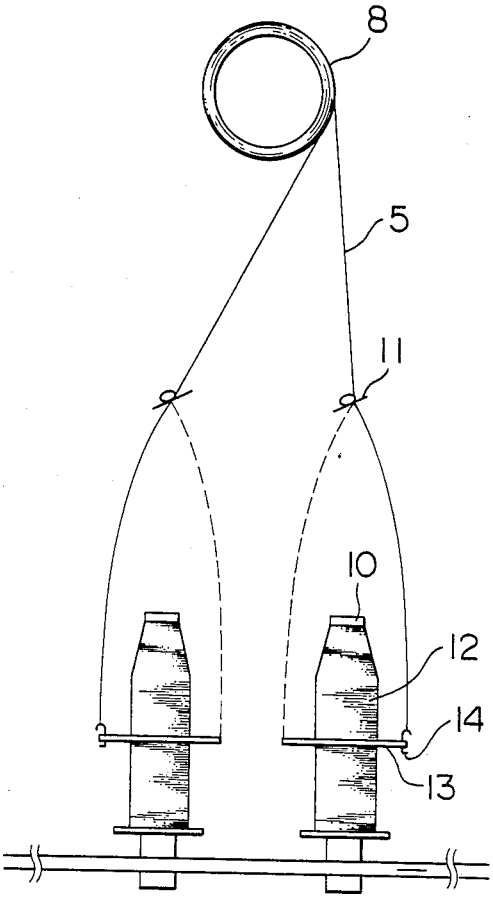
FIG. 3 is a schematic view showing how glass yarns are formed from two strands drawn out from the cake formed by the apparatus of FIG. 1.

FIG. 1 schematically shows one example of an apparatus used to form a cake with a multi-hole bushing as the preparatory step of manufacturing glass yarns according to the present invention. A large number of filaments 2 are drawn out through a large number of orifices formed on the bottom of a multi-hole bushing 1. Sizing agents are coated on the filaments by a sizing agent coating device 3, and the filaments are then separately gathered into two strands 5 by two gethering rollers 4 aligned in such a manner as to be separated from each other by a predetermined gap d. Although this embodiment involves the formation of two strands, it is to be noted that the number of strands can be increased to three or four in accordance with the number of gathering rollers mounted, without departing from the scope of this invention. The thus-formed two strands are simultaneously traversed by a traverse motion 6, and are wound on a winding tube 9 fitted onto a winding collet 7 so as to form a cake 8.

The traverse motion 6 which is of the known type has a traverse shaft S, and two wires A and B wound about the shaft S through about 180 degrees and formed in a spiral shape whose radius from the shaft gradually decreases. The two wires A and B which have the same shape are disposed on different sides of the plane which passes through the axis of the traverse shaft S, as if they are 180 degrees out of phase with respect to the shaft S, and are mounted on the shaft in such a manner that the directions in which the radii thereof from the traverse shaft decrease as well as the mounting positions are completely reversed. Tension is applied to the strands 5 extending between the gathering rollers 4 and the winding tube 9 as the result of the strands' contact with the wire A or B of the traverse motion 6. As the traverse shaft rotates, the strands move on the first wire from the large diameter portion thereof to the small diameter portion, move onto the large diameter portion of the second wire from the small diameter portion of the first wire, and move on the second wire in the opposite direction from that in which it moved on the first wire, toward the small diameter portion thereof. Thus, the strands 5 are alternately moved in opposite directions by the wires A and B, and are hence traversed. During this time, the traverse shaft S is moved back and forth at a predetermined stroke in the axial direction. As a result, the strands 5 which are wound on the winding tube form one cake 8 whose cross-section is trapezoidal. Movement of the two strands 5 in the axial direction is stopped temporarily at the turns of the traverse motion, i.e., as the strands move from the small diameter portion of either of the wires A and B onto the large diameter portion of the other wire B or A, during which the strands are integrated. As a result, the strands 5*a* and 5*b* which are wound into the cake have portions whose strands are integrated and portions whose strands are separated into two and disposed side by side, alternately.

The cake 8 which has been formed from the plurality of (two) strands 5 is air dried by being left as it is at a temperature of 25° to 30° C. and at a humidity of 40 to 55% for 5 to 15 hours, so as to be gathered efficiently by means of sizing agents. During this time the integrated portions of the two strands are adhered to each other to some degree.

The dried cake 8 is then set to a creel of a rewinder. The rewinder is classified into two types by its creel: one whose creel is of the forcibly rotated type, and the other whose creel is rotated by the pulling force of the strands. The present invention can be carried out with either type. The ends of the strands are then drawn out from the surface of the cake 8 set on the creel. At this time, care must be taken not to entangle and break the plurality of strands. The ends of the plurality of drawn strands 5 are individually wound on the plurality of bobbins 10, thus starting the rewinding process. In this rewinding process, each of the strands 5 which have been drawn out from the cake 8 is passed first through a centering eye 11 then a traveller 14 mounted on a ring 13, and is wound on the bobbin 10 rotated at a fixed speed. At this time, each of the strands 5 is twisted by the rotation of the traveller 14. The thus-formed glass yarn forms a yarn package 12 wound on the bobbin.

As can be seen from the foregoing description, the present invention is characterized by the inclusion of the steps of: forming one cake from a plurality of strands, rewinding the plurality of strands from the cake, and forming the plurality of glass yarns at one time. In order to manufacture glass yarns of good quality, it has been found out from the experiments that it is necessary to set the spinning conditions such that the following requirements are satisfied. In other words, the present inventors have found out that the strands which do not get fluffy readily in the rewinding process and whose filaments are less broken can be formed by setting the spinning conditions such that the plurality of strands 5 are separated from each other by a gap of 2 to 3 mm on the winding tube and that the average length of the adhered portions of the strands which are formed by the turns of the traverse motion is between 150 and 350 mm. TThe spinning conditions to be set include the gap d between adjacent gathering rollers 4, the drawing speed, the rotational speed of the traverse motion 6, the shape of the traverse wires A and B, the positional relation of the gathering rollers 4, and so on. It is essential to satisfy the above-described requirements by suitably adjusting these conditions.

Although the required average length of the adhered portions is between 150 and 350 mm, the length of the individual adhered portions may deviate within a certain range (between about 50 and 500 mm). This is due to fluctuation of drawing tension and change in the shape of the cake.

Figure 4:
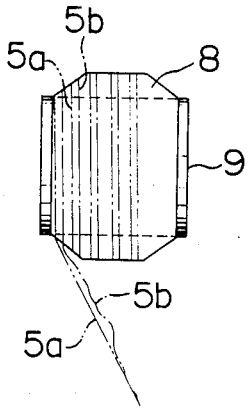
FIG. 4 is an enlarged view of the cake formed by the apparatus of FIG. 1, showing the two strands which are being drawn out from the tapered portion of the cake whose cross-section is trapezoidal.

If the gap between the adjacent strands is larger than 3 mm, the lengths of the strands 5*a* and 5*b* drawn out from the tapered portion of the cake 8 differ, as shown in FIG. 4, and the strands 5*b* becomes loose. This results in the generation of a loop on the strand extending between the centering eye 11 and the traveller 14, and this loop is caught by the traveller 14, causing breakage of strand. When the strands are separated by a gap of 2 to 3 mm, even if one of the strands becomes slightly loose, that looseness can be absorbed by ballooning applied to the strands extending between the centering eye 11 and the traveller 14, so no breakage occurs. If the gap between the adjacent strands is less than 1 mm, the plurality of strands which have been wound into the cake may be adhered to each other at locations other than the portions which have been wound by the turns of the traverse motion. This leads to adherence of the plurality of strands and hence to entangling of the filaments between the adjacent strands. It also increases the possibility of breakage of the filaments during rewinding, thereby increasing the tendency of fluffs being generated. Generation of fluffs can lead to filament breakage and reduction in quality of glass yarns.

If the average length of the adhered portions of the strands which are formed by the turns of the traverse motion is extremely long (more than 350 mm), the filaments in the adjacent strands tends to be intertwined, this leading to the generation of fluffs. To reduce the average length of the adhered portions to 150 mm or less is practically impossible by a normal traverse method such as that adopted by the present invention.

The provision of the adhered portions in the plurality of strands can facilitate drawing out of the strand ends from the cake in the preparatory work of the rewinding process. In the case of a cake from which strands are drawn to form a roving, the strand ends can be drawn out relatively easily because they are drawn out from the inner periphery of the cake and because the cake has been dried by heating it. On the other hand, skillful technique is required to draw out the strands ends from the yarn cake, since the integrity of the strands is not so high as that of the roving cake owing to the fact that the cake has been air dried. Drawing out strand ends from the yarn cake is difficult, also because the strands are drawn out from the outer periphery of the cake, the strand has a small tex, and the diameter of the filaments is small. Even in a normal one-strand one-cake process, this drawing work must be done very carefully. Therefore, much more care must be taken to draw out the ends of the plurality of divided strands which have been wound on one cake. This, however, can be done relatively easily according to the present invention, because the plurality of strands have adhered portions from which the drawing can be started. The plurality of drawn strands are then individually wound on the bobbins in the order that they are wound on the cake. Thus, the strands can be drawn out without being entangled, and breakage of the strands that might occur at the initial stage of the rewinding process can be avoided. Thus, the preparatory work of the rewinding process can be facilitated by the provision of the adhered portions of the strands.

Table 1 shows the results of comparison on the glass yarns ECE 225 1/01Z in the eleven examples prepared according to the method of this invention and that in one conventional example.

TABLE 1

| | Conventional Example | Experimental Example 1 | Experimental Example 2 | Experimental Example 3 | Experimental Example 4 | Experimental Example 5 |
|---|---|---|---|---|---|---|
| Number of strands (Number/cake) | 1 | 2 | 2 | 2 | 3 | 2 |
| Gap between adjacent gathering rollers (mm) | — | 40 | 40 | 45 | 40 | 30 |
| rpm of traverse wires (rpm) | 1600 | 1600 | 1400 | 1600 | 1600 | 1800 |
| Drawing speed (m/min) | 3600 | 3600 | 3600 | 3600 | 3600 | 3600 |
| Actual length of adhered portions (mm) | — | 500–42 | 520–30 | 350–10 | 900–35 | 1065–230 |
| Average length of adhered portions (mm) | — | 200 | 190 | 150 | 300 | 500 |
| Max. gap of adjacent strands (mm) | — | 2 | 3 | 4 | 2 | 1 |

TABLE 1-continued

| | | | | | | |
|---|---|---|---|---|---|---|
| Rate of breakage during rewinding (%) | 0–5 | 0–6 | 0–10 | 3–12 | 0–9 | 10–20 |
| End finding Number per unit time/person | 210 | 190 | 190 | 105 | 160 | 190 |

| | Experimental Example 6 | Experiment Example 7 | Experiment Example 8 | Experiment Example 9 | Experiment Example 10 | Experiment Example 11 |
|---|---|---|---|---|---|---|
| Number of strands (Number/cake | 2 | 2 | 3 | 3 | 2 | 2 |
| Gap between adjacent gathering rollers (mm) | 30 | 50 | 30 | 50 | 45 | 35 |
| rpm of traverse wires (rpm) | 1600 | 1600 | 1600 | 1600 | 1700 | 1600 |
| Drawing speed (m/min) | 3600 | 3600 | 3600 | 3600 | 3600 | 3600 |
| Actual length of adhered portions (mm) | 1350–70 | 350–0 | 1900–480 | 500–35 | 450–25 | 550–45 |
| Average length of adhered portions (mm) | 650 | 140 | 850 | 190 | 150 | 350 |
| Ma. gap of adjacent strands (mm) | 1 | 5 | 1 | 5 | 2 | 2 |
| Rate of breakage during rewinding (%) | 10–20 | 5–13 | 10–25 | 4–20 | 0–7 | 0–10 |
| End finding Number per unit time/person | 193 | 90 | 185 | 95 | 180 | 200 |

As can be seen from the table 1, rewinding process which was as excellent as that provided in the one-cake one-strand manufacturing method could be provided by the present invention when the spinning conditions were set such that the strands were separated by a gap of 2 to 3 mm on the cake and that the average length of the adhered portions formed by the turns of the traverse motion was between 150 and 350 mm.

According to the glass yarn manufacturing method of this invention, it is possible to increase the production amount per one bushing twice or more when compared with the conventional method. Increase in the production amount can be achieved in the present invention without changing the equipment except for the bushing.

Further, according to the present invention, yarns to be manufactured can be easily switched over by changing the spinning conditions without replacing bushings, if these yarns have the same filament diameter but different number of filaments. This switching-over can be done very easily, for example, between:

ECD900 (5μ, 100 filaments) and
ECD450 (5μ, 200 filaments)
ECE225 (7μ, 200 filaments) and
ECE110 (7μ, 400 filaments)
ECG150 (9μ, 200 filaments) and
ECG 75 (9μ, 400 filaments).

This results in the saving of labor, time, and cost required to replace the bushing.

In addition, since the number of cakes is decreased to one half or less, labors required to draw out the strand ends and set the cake to the creel in the preparatory work of the rewinding process can be saved. Labor can also be saved from the viewpoint of conveyance and storage of cakes.

The conventional method requires the same number of creels as that of the spindle. However, the number of creels required in the method of the present invention can be decreased to one half or less of the number of spindles, thereby decreasing the amount of capital investment.

What is claimed is:

1. A method of manufacturing glass yarns which includes the steps of: forming a large number of glass filaments by drawing molten glass through a large number of orifices formed on the bottom of a bushing; forming a plurality of strands by separately gathering said large number of glass filaments, after sizing agents have been applied thereto, with a plurality of gathering rollers aligned in such a manner that they are separeted from each other by a predetermined gap; winding said plurality of strands on one winding tube mounted on a collet while traversing said strands by one traverse motion and thereby forming one cake; drawing out the ends of said plurality of strands from the outer periphery of said cake and rewinding said cake in the state wherein said strands are separated from each other by a rewinder after said cake has been air dried; and winding each of said strands as a glass yarn on a bobbin while twisting it, wherein the improvement is characterized in that the gap between adjacent gathering rollers, the drawing speed, and the rotational speed and shape of said traverse motion are set such that they ensure that said plurality of strands which are wound on said winding tube so as to form said cake are separated from each other by 2 to 3 mm, and that the average length of the adhered portions of said strands which are formed by being passed through the turns of said traverse motion is between 150 and 350 mm.

2. A method of manufacturing glass yarns according to claim 1, wherein, when rewinding of said cake is started, said adhered portions of said strands are used as a guide for strand end drawing work.

3. Method of manufacturing glass yarns which includes the steps of:

(A) forming a large number of glass filaments by drawing molten glass through a large number of orifices formed on the bottom of a bushing;

(B) forming a plurality of strands by separately gathering said large number of glass filaments, after sizing agents have been applied thereto, with a plurality of gathering rollers aligned in such a manner that they are separated from each other by a predetermined gap; and (C) winding said plurality of strands on one winding tube mounted on a collet while traversing said strands by one traverse motion and thereby forming one cake;

said steps (B) and (C) being carried out with the gap between adjacent gathering rollers, the drawing speed, and the rotational speed and shape of said traverse motion being set such that they insure that said plurality of strands which are wound on said winding tube so as to form said cake are separated from each other by 2 to 3 mm, and that the average length of the adhered portions of said strands which are formed by being passed through the turns of said traverse motion is between 150 and 350 mm; and thereafter (D) drawing out the ends of said plurality of strands from the outer periphery of said cake in a direction perpendicular to the axis of the winding tube, and rewinding said cake in the state wherein said strands are separated from each other by a rewinder after said cake has been air dried, by winding each of said strands as a glass yarn on a bobbin while twisting it;

whereby to avoid the generation of filament fluffs during the winding on the rewinder, and breakage of filaments, and thus enable glass yarns of good quality to be manufactured efficiently.

* * * * *